US006447640B1

(12) United States Patent
Watson et al.

(10) Patent No.: US 6,447,640 B1
(45) Date of Patent: Sep. 10, 2002

(54) IMPINGEMENT AIR DRY PROCESS FOR MAKING ABSORBENT SHEET

(75) Inventors: Gary M. Watson, Vancouver, WA (US); Steven L. Edwards, Fremont, WI (US)

(73) Assignee: Georgia-Pacific Corporation, Atlanta, GA (US)

( * ) Notice: Subject to any disclaimer, the term of this patent is extended or adjusted under 35 U.S.C. 154(b) by 0 days.

(21) Appl. No.: 09/836,928

(22) Filed: Apr. 18, 2001

Related U.S. Application Data

(60) Provisional application No. 60/199,301, filed on Apr. 24, 2000.

(51) Int. Cl.[7] ..... D21F 1/00; D21F 5/02

(52) U.S. Cl. ..... 162/101; 162/109; 162/111; 162/113; 162/117; 162/207

(58) Field of Search ..... 162/109, 111, 162/113, 116, 117, 207, 101

(56) References Cited

U.S. PATENT DOCUMENTS

| | | | | | |
|---|---|---|---|---|---|
| 1,641,739 | A | | 9/1927 | Cofrin | |
| 1,772,185 | A | | 8/1930 | Liebeck | |
| 3,203,850 | A | | 8/1965 | McCarty | 162/113 |
| 3,301,746 | A | | 1/1967 | Sanford et al. | 162/113 |
| 3,432,936 | A | | 3/1969 | Cole et al. | 34/6 |
| 3,507,745 | A | | 4/1970 | Fuerst | 162/281 |
| RE28,459 | E | | 7/1975 | Cole et al. | 34/6 |
| 3,994,771 | A | | 11/1976 | Morgan, Jr. et al. | 162/113 |
| 4,102,737 | A | | 7/1978 | Morton | 162/113 |
| 4,356,059 | A | | 10/1982 | Hostetler | 162/111 |
| 4,440,597 | A | | 4/1984 | Wells et al. | 162/111 |
| 4,529,480 | A | | 7/1985 | Trokhan | 162/109 |
| 5,087,324 | A | | 2/1992 | Awofeso | 162/111 |
| 5,232,555 | A | | 8/1993 | Daunais et al. | 162/193 |
| 5,336,373 | A | | 8/1994 | Scattolino et al. | 162/116 |
| 5,385,644 | A | * | 1/1995 | Hannus et al. | 162/207 |
| 5,411,636 | A | | 5/1995 | Hermans et al. | 162/109 |
| 5,494,554 | A | | 2/1996 | Edwards et al. | 162/111 |
| 5,510,002 | A | | 4/1996 | Hermans et al. | 162/113 |
| 5,512,139 | A | | 4/1996 | Worcester | 162/111 |
| 5,569,359 | A | * | 10/1996 | Joiner | 162/207 |
| 5,607,551 | A | | 3/1997 | Farrington, Jr. et al. | 162/109 |
| 5,851,353 | A | | 12/1998 | Fiscus et al. | 162/113 |
| 5,865,955 | A | | 2/1999 | Ilvespaa et al. | 162/207 |
| 5,891,309 | A | | 4/1999 | Page et al. | 162/281 |
| 5,968,590 | A | | 10/1999 | Ahonen et al. | 427/209 |
| 6,001,421 | A | | 12/1999 | Ahnonen et al. | 427/316 |
| 6,119,362 | A | | 9/2000 | Sundqvist | 34/120 |
| 6,187,137 | B1 | * | 2/2001 | Druecke et al. | 162/207 |
| 6,228,220 | B1 | * | 5/2001 | Hada et al. | 162/207 |
| 6,294,050 | B1 | * | 9/2001 | Oeschsle et al. | 162/207 |
| 6,322,667 | B1 | * | 11/2001 | McCall et al. | 162/207 |

OTHER PUBLICATIONS

"Total Machine Concept and Considerations for Thru–Air–Dried Tissue Paper", EUCEPA 34th Conf. Proc. F(Stockholm), Pap. Technol :310–320 (May 8–11, 1990), of B.K.G. Glifberg et al.

(List continued on next page.)

*Primary Examiner*—Peter Chin
(74) *Attorney, Agent, or Firm*—Michael W. Ferrell

(57) ABSTRACT

A process for making absorbent sheet includes: (a) depositing an aqueous furnish of cellulosic fiber on a forming fabric; (b) dewatering the wet web to a consistency of from about 15 to about 40 percent; (c) transferring the dewatered web from the forming fabric to another fabric traveling at a speed of from about 10 to about 80 percent slower than the forming fabric; (d) wet-shaping the web on an impression fabric whereby the web is macroscopically rearranged to conform to the surface of the impression fabric; and (e) impingement air drying the web. The process is particularly suitable for making high bulk products form difficult to process furnishes such as recycle furnishes and for making high basis weight products without compressive dewatering with a papermaking felt.

40 Claims, 7 Drawing Sheets

OTHER PUBLICATIONS

"Economic Considerations in Through–Air Drying", Pap. News (Valmet) 6, No. 1: 15–16 (1990), of R.A. Parker.

"Convective Heat Transfer Under Turbulent Impinging Slot Jet at Large Temperature Differences", Drying '85 (Toei & Mujumdar, eds.)/Proc.Int.DryingSymp. (Kyoto) 4th: 354–359 (Jul. 9–12, 1984); c1985 Hemisphere Publ. Co.), of D. Das et al.

"Intensification of Paper Web Dewatering and Drying", Przeglad Papier, 45, No. 11: 402–404 (Nov. 1979), of W. Kawka et al.

"Some Problems of Blow–Through Drying of Porous Papers", Przeglad Papier 33, No. 8: 299–305 (Aug. 1977) of W. Kawka et al.

* cited by examiner 13 lb BASIS WEIGHT

IMPINGEMENT AIR DRY PROCESS FOR MAKING ABSORBENT SHEET

Claim for Priority

This non-provisional application claims the benefit of the filing date of U.S. Provisional Patent Application Serial No. 60/199,301, of the same title, filed Apr. 24, 2000.

TECHNICAL FIELD

The present invention relates to methods of making absorbent cellulosic sheet in general, and more specifically to a process for making a non-compressively dewatered, impingement air dried absorbent sheet.

BACKGROUND

Methods of making paper tissue, towel, and the like are well known. Typically, such processes include conventional wet pressing and throughdry processes. Conventional wet pressing processes have certain advantages over conventional through air drying processes including: (1) lower energy costs associated with the mechanical removal of water rather than transpiration drying with hot air; (2) higher production speeds are more readily achieved with processes which utilize wet pressing to form a web; and (3) the process is relatively robust in that it does not require a highly permeable substrate. On the other hand, throughair drying processes have become the method of choice for new capital investment, particularly for producing soft, bulky, premium quality tissue and towel products.

One method of making throughdried products is disclosed in U.S. Pat. No. 5,607,551 to Farrington, Jr. et al. wherein uncreped, through dried products are described. According to the '551 patent, a stream of an aqueous suspension of papermaking fibers is deposited onto a forming fabric and partially dewatered to a consistency of about 10 percent. The wet web is then transferred to a transfer fabric travelling at a slower speed than the forming fabric in order to impart increased stretch into the web. The web is then transferred to a throughdrying fabric where it is dried to a final consistency of about 95 percent or greater employing a vacuum of from about 3 to about 15 inches of mercury.

There is disclosed in U.S. Pat. No. 5,510,002 to Hermans et al. various throughdried, creped products. There is taught in connection with FIG. 2, for example, a throughdried/wet-pressed method of making crepe tissue wherein an aqueous suspension of papermaking fibers is deposited on a forming fabric, dewatered in a press nip between a pair of felts followed by wet straining the web on a throughair drying fabric, and throughair drying. The throughdried web is adhered to a Yankee dryer, further dried and creped to yield the final product.

Throughdried, creped products are also disclosed in the following patents: U.S. Pat. No. 3,994,771 to Morgan, Jr. et al.; U.S. Pat. No. 4,102,737 to Morton; and U.S. Pat. No. 4,529,480 to Trokhan. The processes described in these patents comprise, very generally, forming a web on a foraminous support, thermally pre-drying the web, applying the web to a Yankee dryer with a nip defined, in part, by an impression fabric and creping the product therefrom.

As noted in the above, throughdried products tend to exhibit enhanced bulk and superior tactile properties; however, conventional thermal dewatering with hot air tends to be energy intensive and requires a relatively permeable substrate. Thus, wet-press operations are preferable from an energy perspective and are more readily applied to high basis weight products and products made from furnishes containing recycle fiber which tends to form webs with less permeability than virgin fiber. However, wet press operations tend to utilize more fiber and thus are more costly on a square foot basis.

The state of the art is perhaps further understood by way of the following patents. It will be appreciated that high production rates (sheet speeds) are exceedingly important to the viability of any particular production process due to the large investment. In connection with paper manufacture, it has been suggested, for example, to employ an air foil to stabilize web transfer off of a Yankee dryer in order to maintain suitable production rates.

There is disclosed in U.S. Pat. No. 5,851,353 to Fiscus et al. a method for can drying wet webs for tissue products wherein a partially dewatered wet web is restrained between a pair of molding fabrics. The restrained wet web is processed over a plurality of can dryers, for example, from a consistency of about 40 percent to a consistency of at least about 70 percent. The sheet molding fabrics protect the web from direct contact with the can dryers and impart an impression on the web.

There is disclosed in U.S. Pat. No. 5,087,324 to Awofeso et al. a delaminated stratified paper towel. The towel includes a dense first layer of chemical fiber blend and a second layer of a bulky anfractuous fiber blend unitary with the first layer. The first and second layers enhance the rate of absorption and water holding capacity of the paper towel. The method of forming a delaminated stratified web of paper towel material includes supplying a first furnish directly to a wire and supplying a second furnish of a bulky anfractuous fiber blend directly on to the first furnish disposed on the wire. Thereafter, a web of paper towel is creped and embossed.

There is disclosed in U.S. Pat. No. 5,494,554 to Edwards et al. the formation of wet press tissue webs used for facial tissue, bath tissue, paper towels, or the like, produced by forming the wet tissue in layers in which the second formed layer has a consistency which is significantly less than the consistency of the first formed layer. The resulting improvement in web formation enables uniform debonding during dry creping which, in turn, provides a significant improvement in softness and reduction in linting. Wet pressed tissues made with the process according to the '554 patent are internally debonded as measured by a high void volume index.

As will be appreciated from the foregoing, processes for making absorbent sheet generally incorporate two types of drying: (1) can drying where high density, low permeability can be tolerated and (2) throughdrying which requires a permeable substrate. The present invention is directed to making high bulk products wherein the permeability of the substrate is not critical.

SUMMARY OF INVENTION

There is provided in one aspect of the present invention a method of making absorbent sheet including the steps of: (a) depositing an aqueous furnish comprising cellulosic fiber on a foraminous support; (b) dewatering (preferably non-compressively dewatering) the wet web to a consistency of from about 15 to about 40 percent; (c) transferring the dewatered web at the aforesaid consistency to another fabric traveling at a speed of from about 10 to about 80 percent slower than the speed of the web prior to transfer; (d) macroscopically rearranging the web to conform to the shape of an impression fabric; and (e) impingement air drying the web to form an absorbent sheet. Typically, the web is dewatered to a consistency of from about 20 to about 30 percent prior to transfer and impingement air dried at a rate of from about 25–50 lbs of water removed per hour per square foot of drying area. Drying rates of from about 30–40 lbs/hr-ft$^2$ are typical, over drying lengths of from about 50 to 300 feet. Impingement air drying lengths are typically from about 75 to about 200 feet, with from about 100 to 150 feet being a preferred construction of a paper machine to practice the present invention.

Most typically, the step of impingement air drying is carried out over a plurality of impingement air dryers including rotating cylinders and drying hoods sequentially arranged in a row opposing a row of reversing vacuum cylinders over which the web travels. In this arrangement, impingement exhaust air from a downline dryer can be cascaded backward to an upline dryer operating at higher humidity.

A product of any typical basis weight may be made by way of the present invention, suitably having a weight of at least 10 lbs/3000 ft$^2$. Higher basis weight products, having basis weights of at least 15 lbs/3000 ft$^2$ or at least 20 lbs/3000 ft$^2$ may also be produced as will readily be appreciated from the discussion which follows.

Typically, the web is impingement air dried to a consistency of at least about 90% and in preferred embodiments to a consistency of about 95 percent or so.

In another aspect of the present invention, there is provided the additional steps of: adhering the impingement air dried web to a rotating cylinder and creping the web from the cylinder. A creping adhesive may be used, and the cylinder may be heated if so desired.

There is provided in still yet another aspect of the present invention a method of making an absorbent sheet including the steps of: (a) depositing an aqueous furnish comprising cellulosic fiber on a forming fabric; (b) dewatering the wet web to a consistency of from about 15 to about 40%; (c) transferring the dewatered web from the forming fabric to a transfer fabric traveling at a speed of from about 10 to about 80% slower than the forming fabric; (d) transferring the web to an impression fabric whereby the web is macroscopically rearranged to conform to the surface of the impression fabric; and (e) impingement air drying the web. Typically, the wet web is dewatered to a consistency of from about 20 to about 30% in step (b). So also, the transfer fabric is typically traveling at a speed of from about 15 to about 40% slower than the forming fabric.

Any suitable aqueous furnish may be employed; in many embodiments the furnish includes recycled fiber. Recycled fiber may be present in any amount;

particularly preferred embodiments oftentimes include at least about 50 percent by weight recycled fiber, based on the amount of fiber present. More than about 75 percent by weight of the fiber may be recycled fiber or the cellulosic fiber in the furnish may consist entirely of recycled fiber.

In order to achieve enhanced bulk and softness it may be desirable in many embodiments to subject at least a portion of the fiber to a curling process. For example, one may subject at least about 10 percent of the fiber in the aqueous furnish to a curling process or at least about 25 percent of the fiber in the furnish to a curling process. Where particularly high bulk is desired, one may subject 75%, 90% or even more of the fiber present in the aqueous furnish to a curling process. While any suitable curling process may be used to increase the curl inherent in the fiber, a particularly preferred process includes concurrently heat treating and convolving the fiber at an elevated temperature. Such processes may be carried out in a disk refiner, for example, with saturated steam at a pressure of from about 5 to about 150 psig. Another method of increasing the bulk may include foam forming the furnish on the forming fabric as is known in the art. See, for example, U.S. Pat. No. 5,200,035, the disclosure of which is incorporated herein by reference.

In a typical embodiment, the aqueous furnish will further include a debonding agent, such as a cationic debonding agent. In some embodiments, it may be preferred to include both a cationic debonding agent and a non-ionic surfactant.

It is desirable to dry the web at the highest rate achievable with the impingement air dryer. Preferably a drying rate of at least about 30 pounds of water removed per square foot of impingement air drying surface per hour is preferred. More preferably, a drying rate of at least 40 pounds of water removed per square foot of impingement air drying surface per hour is attained.

The present invention further includes absorbent sheet made by the aforesaid process.

BRIEF DESCRIPTION OF THE DRAWINGS

The present invention is described in detail below with reference to the various figures. In the figures:

FIG. 7(*b*) is a diagram illustrating the operation of the impingement air drying apparatus of FIG. 7(*a*);

DETAILED DESCRIPTION

Figure 1A:
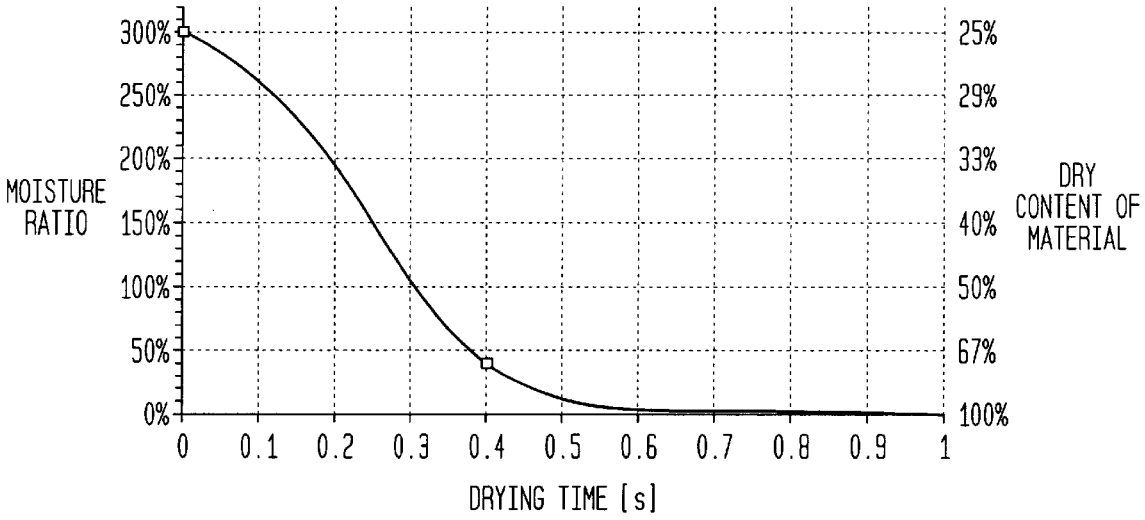
FIGS. 1(*a*) and 1(*b*) are plots showing drying time and air permeability for a 9 lb/3000 ft$^2$ basis weight absorbent sheet.

The present invention is described in detail below for purposes of exemplification only. Various modifications within the spirit and scope of the present invention, set forth in the appended claims, will be readily apparent to those of skill in the art. According to the present invention, an absorbent paper web can be made by dispersing fibers into aqueous slurry and depositing the aqueous slurry onto the forming wire of a papermaking machine. Any art recognized forming technique might be used. For example, an extensive but non-exhaustive list includes a crescent former, a C-wrap twin wire former, an S-wrap twin wire former, a suction breast roll former, or a Fourdrinier former. The particular forming apparatus is not critical to the success of the present invention. The forming fabric can be any suitable foraminous member including single layer fabrics, double layer fabrics, triple layer fabrics, photopolymer fabrics, and the like. Non-exhaustive background art in the forming fabric area include U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,261; 5,199,467; 5,211,815; 5,219,004; 5,245,025; 5,277,761; 5,328,565; and 5,379,808 all of which are incorporated herein by reference in their entirety. The particular forming fabric is not critical to the success of the present invention. One forming fabric particularly useful with the present invention is Voith Fabrics Forming Fabric 2184 made by Voith Fabrics Corporation, Shreveport, La.

Any suitable transfer fabric may be used to transfer the web between the forming fabric and the impression fabric in embodiments of the invention wherein an intermediate transfer fabric is utilized. In this respect, note U.S. Pat. No. 5,607,551 to Farrington et al., the disclosure of which is hereby incorporated by reference. The speed of the transfer fabric is substantially slower than the speed of the forming fabric in order to impart machine direction stretch into the web. Transfer fabrics include single layer, multi-layer or composite permeable structures. Preferred fabrics have at least one of the following characteristics: (1) on the side of the transfer fabric that is in contact with the wet web (the "top" side), the number of machine direction (MD), strands per inch (mesh), is from about 10 to 200 (4–80 per cm) and the number per cm of cross direction (CD) strands per inch (count) is also from about 10 to 200. The strand diameter is typically smaller than 0.050 inch (1.3 mm); and (2) on the top side the distance between the highest point of the MD knuckle and the highest point on the CD knuckle is from about 0.001 to about 0.02 or 0.03 inch (0.025 to about 0.5 or 0.75 mm). In between these two levels, there can be knuckles formed either by MD or CD strands that give the topography a three dimensional characteristic. Specific suitable transfer fabrics include, by way of example, those made by Asten Forming Fabrics Inc., Appleton Wis., and designated as numbers 934, 937, 939 and 959 and Albany 94M manufactured by Albany International, Appleton Wire Division, Appleton Wis.

The impression fabric is also suitably a coarse fabric such that the wet web is supported in some areas and unsupported in others in order to enable the web to flex and response to differential air pressure or other deflection force applied to the web. Such fabric suitable for purposes of this invention include, without limitation, those papermaking fabric which exhibit significant open area or three dimensional surface contour or depression sufficient to impart substantial Z-directional deflection of the web and one disclosed, for example, in U.S. Pat. No. 5,411,636 to Hermans et al., the disclosure of which is hereby incorporated by reference.

Suitable impression fabrics sometimes utilized as throughdrying fabrics likewise include single layer, multi-layer, or composite permeable structures. Characteristics are similar to those of the intermediate transfer fabrics noted above. Preferred fabrics thus have at least one of the following characteristics: (1) on the side of the impression fabric that is in contact with the wet web (the "top" side), the number of machine direction (MD) strands per inch (mesh) is from 10 to 200 and the number of cross direction (CD) strands per inch (count) is also from 10 to 200. The strand diameter is typically smaller than 0.050 inch; (2) on the top side, the distance between the highest point of the MD knuckle and the highest point on the CD knuckle is from about 0.001 to about 0.02 or 0.03 inch. In between these two levels there can be knuckles formed either by MD or CD strands that give the topography a three dimensional hill/valley appearance which is imparted to the sheet during the wet molding step; (3) on the top side, the length of the MD knuckles is equal to longer than the length of the CD knuckles; (4) if the fabric is made in a multi-layer construction, it is preferred that the bottom layer is of a finer mesh than the top layer so as to control the depth of web penetration to maximize fiber retention; and (5) the fabric may be made to show certain geometric patterns that are pleasing to the eye, which is typically repeated between every two to 50 warp yams. Suitable commercially available coarse fabrics include a number of fabrics made by Asten, Forming Fabrics, Inc., including without limitation Asten 934, 920, 52B, and Velostar V800. In embodiments where both a coarse intermediate transfer fabric and an impression fabric are used, the geometry and orientation of the fabrics are orthogonally optimized to provide the desired machine direction and cross-direction stretch.

The consistency of the web when the differential pressure is applied to conform the web to the shape of the forming fabric must be high enough that the web has some integrity and that a significant number of bonds have formed within the web, yet not so high as to make the web unresponsive to the differential air pressure or other pressure applied to force the web into the impression fabric. At consistency approaching dryness, for example, it is difficult to draw sufficient vacuum on the web because of its porosity and lack of moisture. Preferably the consistency of the web about its surface will be from about 30 to about 80 percent and more preferably from about 40 to about 70 percent and still more preferably from about 45 to about 60 percent. While the invention as illustrated below in connection with vacuum molding, the means for deflecting the wet web to create the increase in internal bulk can be pneumatic means, such as positive and/or negative air pressure or mechanical means such as a male engraved roll having protrusions which match up with the depressions in the coarse fabric. Deflection of the web is preferably achieved by differential air pressure, which can be applied by drawing vacuum through the supporting coarse fabric to pull the web into the coarse fabric or by applying the positive pressure into the fabric to push the web into the coarse fabric. A vacuum suction box is a preferred vacuum source because it is common to use in papermaking processes. However, air knives or air presses can also be used to supply positive pressure, where vacuums cannot provide enough pressure differential to create the desired effect. When using a vacuum suction box the width of the vacuum slot can be from approximately 1/16 inch to whatever size is desired as long as sufficient pump capacity exists to establish sufficient vacuum time. It is common practice to use vacuum slot from 1/8 inch to 1/2 inch.

The magnitude of the pressure differential and the duration of the exposure of the web to the pressure differential can be optimized depending on the composition of the furnish, the basis weight of the web, the moisture content of the web, the design of the supporting coarse fabric and the speed of the machine. Suitable vacuum levels can be from about 10 inches of mercury to about 30 inches of mercury, preferably from about 15 to about 25 inches of mercury and most preferably about 20 inches of mercury.

Papermaking fibers used to form the absorbent products of the present invention include cellulosic fibers commonly referred to as wood pulp fibers, liberated in the pulping process from softwood gymnosperms or coniferous trees and hardwoods (angiosperms or deciduous trees). Cellulosic fibers from diverse material origins may also be used to form the web of the present invention. These fibers include non-woody fibers liberated from sugar cane, bagasse, sabai grass, rice straw, banana leaves, paper mulberry (i.e., bast fiber), abaca leaves, pineapple leaves, esparto grass leaves, and fibers from the genus hesperaloe in the family Agavaceae. Also recycled fibers which may contain all of the above fiber sources in different percentages, can be used in the present invention. Suitable fibers are disclosed in U.S. Pat. Nos. 5,320,710 and 3,620,911, both of which are incorporated herein by reference.

Papermaking fibers can be liberated from their source material by any one of a number of chemical pulping processes familiar to one experienced in the art including sulfate, sulfite, polysulfide, soda pulping, etc. The pulp can be bleached if desired by chemical means including the use of chlorine, chlorine dioxide, oxygen, etc. Furthermore, papermaking fibers can be liberated from source material by any one of a number of mechanical/chemical pulping processes familiar to anyone experienced in the art including mechanical pulping, thermomechanical pulping, and chemithermomechanical pulping. These mechanical pulps can be bleached, if necessary, by a number of familiar bleaching schemes including alkaline peroxide and ozone bleaching.

Furnishes utilized in connection with the present invention may contain significant amounts of secondary fibers that possess significant amounts of ash and fines. It is common in the industry to hear the term ash associated with virgin fibers. This is defined as the amount of ash that would be created if the fibers were burned. Typically no more than about 0.1% to about 0.2% ash is found in virgin fibers. Ash as used in the present invention includes this "ash" associated with virgin fibers as well as contaminants resulting from prior use of the fiber. Furnishes utilized in connection with the present invention may include excess of amounts of ash greater than about 1% or more. Ash originates when fillers or coatings are added to paper during formation of a filled or coated paper product. Ash will typically be a mixture containing titanium dioxide, kaolin clay, calcium carbonate and/or silica. This excess ash or particulate matter is what has traditionally interfered with processes using recycle fibers, thus making the use of recycled fibers unattractive. In general recycled paper containing high amounts of ash is priced substantially lower than recycled papers with low or insignificant ash contents. Thus, there will be a significant advantage to a process for making a premium or near-premium product from recycled paper containing excess amounts of ash.

Furnishes containing excess ash also typically contain significant amount of fines. Ash and fines are most often associated with secondary, recycled fibers, post-consumer paper and converting broke from printing plants and the like. Secondary, recycled fibers with excess amounts of ash and significant fines are available on the market and are inexpensive because it is generally accepted that only very thin, rough, economy towel and tissue products can be made unless the furnish is processed to remove the ash. The present invention makes it possible to achieve a paper product with high void volume and premium or near-premium qualities from secondary fibers having significant amounts of ash and fines without any need to preprocess the fiber to remove fines and ash. While the present invention contemplates the use of fiber mixtures, including the use of virgin fibers, fiber in the products according to the present invention may have greater than 0.75% ash, and sometimes more than 1% ash. The fiber may have greater than 2% ash and may even have as high as 30% ash or more.

As used herein, fines constitute material within the furnish that will pass through a 100 mesh screen. Ash and ash content is defined as above and can be determined using TAPPI Standard Method T211 OM93.

The suspension of fibers or furnish may contain chemical additives to alter the physical properties of the paper produced. These chemistries are well understood by the skilled artisan and may be used in any known combination.

The pulp can be mixed with strength adjusting agents such as wet strength agents, dry strength agents and debonders/softeners. Suitable wet strength agents are known to the skilled artisan. A comprehensive but non-exhaustive list of useful strength aids include urea-formaldehyde resins, melamine formaldehyde resins, glyoxylated polyacrylamide resins, polyamide-epichlorohydrin resins and the like. Thermosetting polyacrylamides are produced by reacting acrylamide with diallyl dimethyl ammonium chloride (DADMAC) to produce a cationic polyacrylamide copolymer which is ultimately reacted with glyoxal to produce a cationic cross-linking wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference in their entirety. Resins of this type are commercially available under the trade name of PAREZ 631NC by Cytec Industries. Different mole ratios of acrylamide/DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorohydrin resins, an example of which is sold under the trade names Kymene 557LX and Kymene 557H by Hercules Incorporated of Wilmington, Delaware and CASCAMID® from Borden Chemical Inc. These resins and the process for making the resins are described in U.S. Pat. No. 3,700,623 and U.S. Pat. No. 3,772,076 each of which is incorporated herein by reference in its entirety. An extensive description of polymeric-epihalohydrin resins is given in Chapter 2: Alkaline-Curing Polymeric Amine-Epichlorohydrin by Espy in Wet Strength Resins and Their Application (L. Chan, Editor, 1994), herein incorporated by reference in its entirety. A reasonably comprehensive list of wet strength resins is described by Westfelt in *Cellulose Chemistry and Technology* Volume 13, p. 813, 1979, which is incorporated herein by reference.

Suitable dry strength agents will be readily apparent to one skilled in the art. A comprehensive but non-exhaustive list of useful dry strength aids includes starch, guar gum, polyacrylamides, carboxymethyl cellulose and the like. Of particular utility is carboxymethyl cellulose, an example of which is sold under the trade name Hercules CMC by Hercules Incorporated of Wilmington, Delaware.

Suitable debonders are likewise known to the skilled artisan. Debonders or softeners may also be incorporated into the pulp or sprayed upon the web after its formation. The present invention may also be used with softener materials within the class of amido amine salts derived from partially acid neutralized amines. Such materials are disclosed in U.S. Pat. No. 4,720,383. Evans, Chemistry and Industry, Jul. 2, 1969, pp. 893–903; Egan, *J.Am. Oil Chemist's Soc.*, Vol. 55 (1978), pp. 118–121; and Trivedi et al., *J.Am. Oil Chemist's Soc.*, June 1981, pp. 754–756, incorporated by reference in their entirety, indicate that softeners are often available commercially only as complex mixtures rather than as single compounds. While the following discussion will focus on the predominant species, it should be understood that commercially available mixtures would generally be used in practice.

Quasoft 202-JR is a suitable softener material, which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably 6 to 7 and most preferably 6.5 to 7.

Quaternary ammonium compounds, such as dialkyl dimethyl quaternary ammonium salts are suitable particularly when the alkyl groups contain from about 14 to 20 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

In some embodiments, a particularly preferred debonder composition includes a quaternary amine component as well as a nonionic surfactant.

The quaternary ammonium component may include a quaternary ammonium species selected from the group consisting of: an alkyl(enyl)amidoethyl-alkyl(enyl)-imidazolinium, dialkyldimethylammonium, or bis-alkylamidoethyl-methylhydroxyethyl-ammonium salt; wherein the alkyl groups are saturated, unsaturated, or mixtures thereof, and the hydrocarbon chains have lengths of from ten to twenty-two carbon atoms. The debonding composition may include a synergistic combination of: (a) a quaternary ammonium surfactant component comprising a surfactant compound selected from the group consisting of a dialkyldimethyl-ammonium salts of the formula:

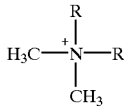

a bis-dialkylamidoammonium salt of the formula:

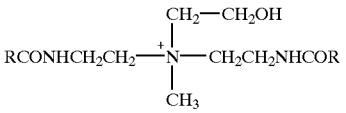

a dialkylmethylimidazolinium salt of the formula:

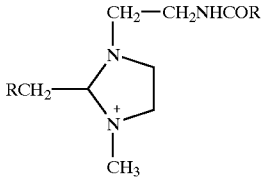

wherein each R may be the same or different and each R indicates a hydrocarbon chain having a chain length of from about twelve to about twenty-two carbon atoms and may be saturated or unsaturated; and wherein said compounds are associated with a suitable anion; and (b) a nonionic surfactant component. Preferably, the ammonium salt is a dialkylimidazolinium compound and the suitable anion is methylsulfate. The nonionic surfactant component typically includes the reaction product of a fatty acid or fatty alcohol with ethylene oxide such as a polyethylene glycol diester of a fatty acid (PEG diols or PEG diesters).

A convenient way to enhance product bulk is to provide in the furnish at the forming end of the process at least a modicum of curled fiber. This may be accomplished by adding commercially available high bulk additive ("HBA") available from Weyerhauser or suitable virgin or secondary fibers may be provided with additional curl as described in one or more of the following patents, the disclosures of which are hereby incorporated by reference into this patent as if set forth in their entirety: U.S. Pat. No. 2,516,384 to Hill et al.; U.S. Pat. No. 3,382,140 to Henderson et al.; U.S. Pat. No. 4,036,679 to Bach et al.; U.S. Pat. No. 4,431,479 to Barbe et al.; U.S. Pat. No. 5,384,012 to Hazard; U.S. Pat. No. 5,348,620 to Hermans et al.; U.S. Pat. No. 5,501,768 to Hermans et al.; or U.S. Pat. No. 5,858,021 to Sun et al. The curled fiber is added in suitable amounts as noted herein, or, one may utilize 100% curled fiber if so desired provided the costs are not prohibitive.

In this latter respect, a particularly cost effective procedure is simply to concurrently heat-treat and convolve the fiber in a pressurized disk refiner at relatively high consistency (20–60%) with saturated steam at a pressure of from about 5 to 150 psig. Preferably, the refiner is operated at low energy inputs, less than about 2 hp-day/ton and at short residence times of the fiber in the refiner. Suitable residence times may be less than about 20 seconds and typically less than about 10 seconds. This procedure produces fiber with remarkably durable curl as described in co-pending U.S. patent application Ser. No. 09/793,863, filed Feb. 27, 2001 (Attorney Docket No. 2247) entitled "Method of Providing Papermaking Fibers with Durable Curl and Absorbent Sheet Incorporating Same", assigned to the Assignee of the present invention, the disclosure of which is hereby incorporated by reference. If so desired, bleaching chemicals such as caustic and hydrogen peroxide may be included to increase the brightness of the product as noted in U.S. patent application Ser. No. 09/793,874, filed Feb. 27, 2001 (Attorney Docket No. 2159) entitled "Method of Bleaching and Providing Papermaking Fibers with Durable Curl", the disclosure of which is also incorporated by reference.

Impingement air drying is known, for example, in connection with drying hoods about Yankee dryers. See Convective Heat Transfer Under Turbulent Impinging Slot Jet at Large Temperature Differences; Voss et al. Department of Chemical Engineering, McGill University, Pulp and Paper Research Institute of Canada, Montreal, Quebec, (Kyoto Conf., 1985). It is distinguished from throughdrying where all or at least most of the drying fluid actually passes through the web. Impingement air drying has been utilized in connection with coated papers. See for example, U.S. Pat. No. 5,865,955 of Ilvespaat et al. as well as the following United States Patents: U.S. Pat. No. 5,968,590 to Ahonen et al.; and U.S. Pat. No. 6,001,421 to Ahonen et al. the disclosures of which are hereby incorporated by reference. In connection with impingement air drying, little, if any, of the drying air passes through the web. Unlike the use of impingement air drying known in the art, the present invention is directed to a process wherein absorbent sheet is impingement air dried on an impression fabric. In preferred embodiments, the web is non-compressively dewatered prior to being impingement air dried. By non-compressively dewatering it is meant that the web is not "squeezed" as in a nip press or as in a nip between a roll and a papermaking felt, for example, as in a typical shoe press prior to being impingement air dried.

The advantages of the present invention over throughdry processes is appreciated by considering FIGS. 1 through 4. Throughdry processes for making absorbent sheet require relatively permeable webs which may or may not be readily formed at high basis weights or with recycle fiber having a relatively high fines content. In this respect, a series of 100% recycle absorbent sheet products were tested suitably for throughdrying by wetting them 300% (consistency of 25%) and drying them with hot air in a throughdry apparatus.

Figure 1B:
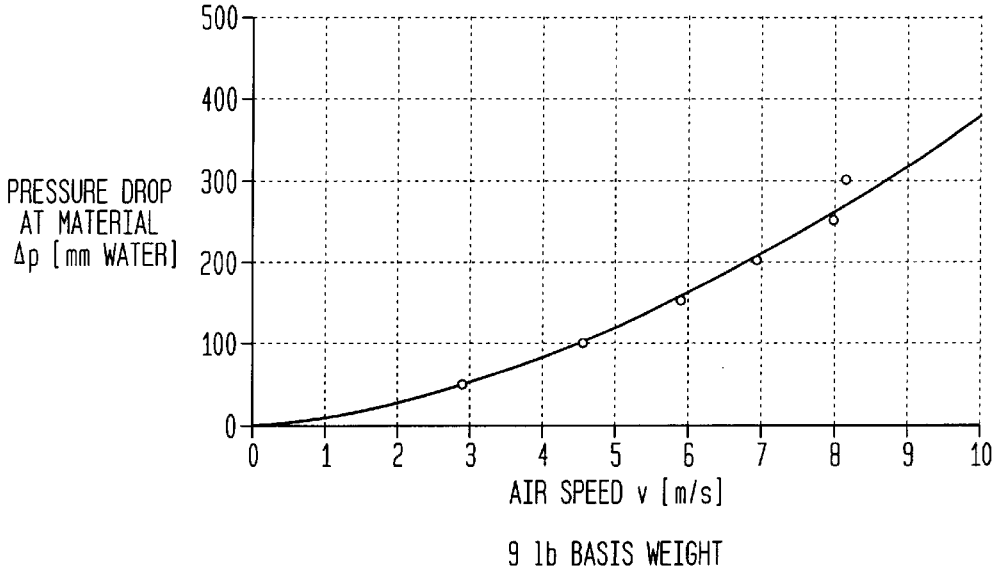

FIG. 1(*a*) is a plot of drying time in seconds versus moisture content for a dry creped, 91b/3000 $ft^2$ product made with recycle furnish, wherein the drying temperature was 230° C. and the pressure drop was about 250 mm of water through the sheet. FIG. 1(*b*) is a plot of air speed through the sheet utilized to generate the drying data of FIG. 1(*a*) at 0% moisture versus pressure drop in mm of water.

Figure 2A:
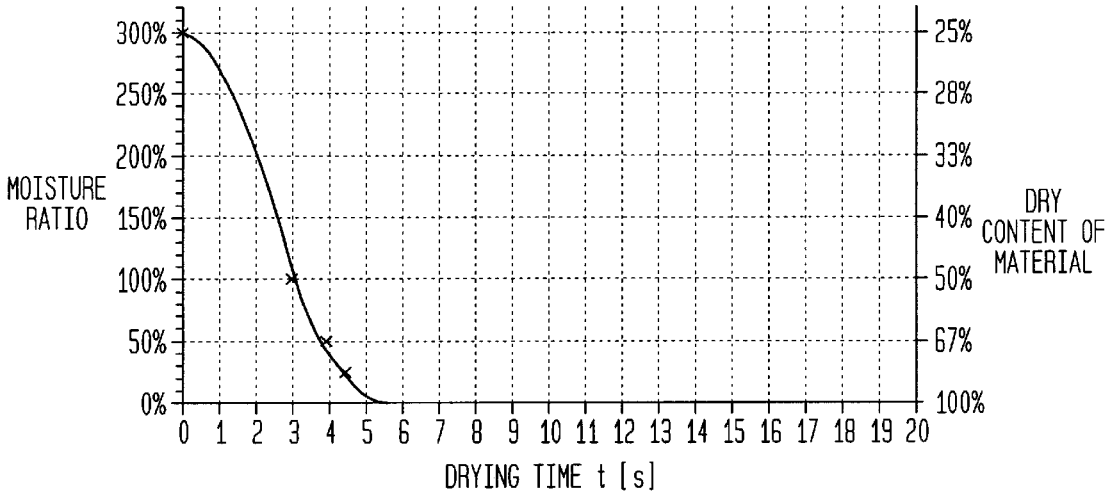
FIGS. 2(*a*) and 2(*b*) are plots showing drying time and air permeability for a 13 lb/3000 ft$^2$ basis weight absorbent sheet.
Figure 2B:
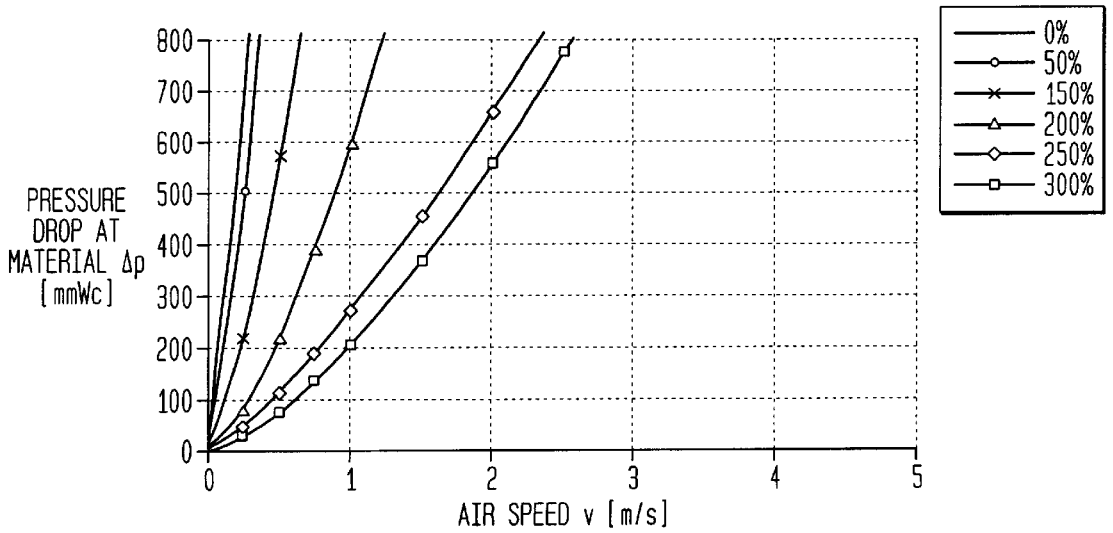

FIG. 2(*a*) is a plot of drying time versus moisture ratio for a wet-creped, 13 lb/3000 $ft^2$ product made with recycle furnish, wherein the drying temperature was 220° C. and the pressure drop was about 480 mm of water through the sheet. FIG. 2(*b*) is a plot of air speed through the sheet versus pressure drop at various moisture levels for the sheet used to generate the drying data of FIG. 2(*a*).

Figure 3A:
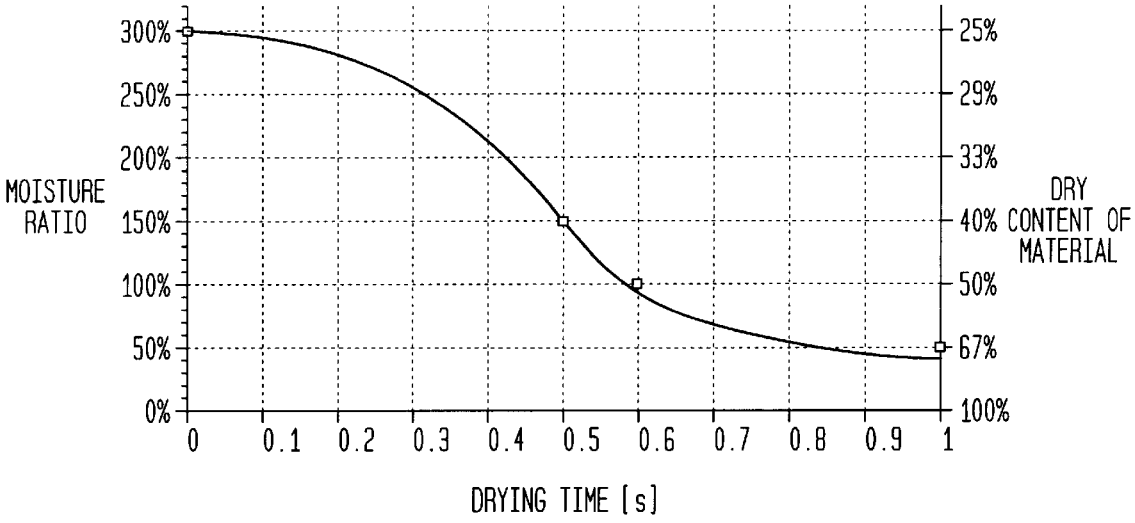
FIGS. 3(*a*) and 3(*b*) are plots showing drying time and air permeability for a 14 lb/3000 ft$^2$ basis weight absorbent sheet.
Figure 3B:
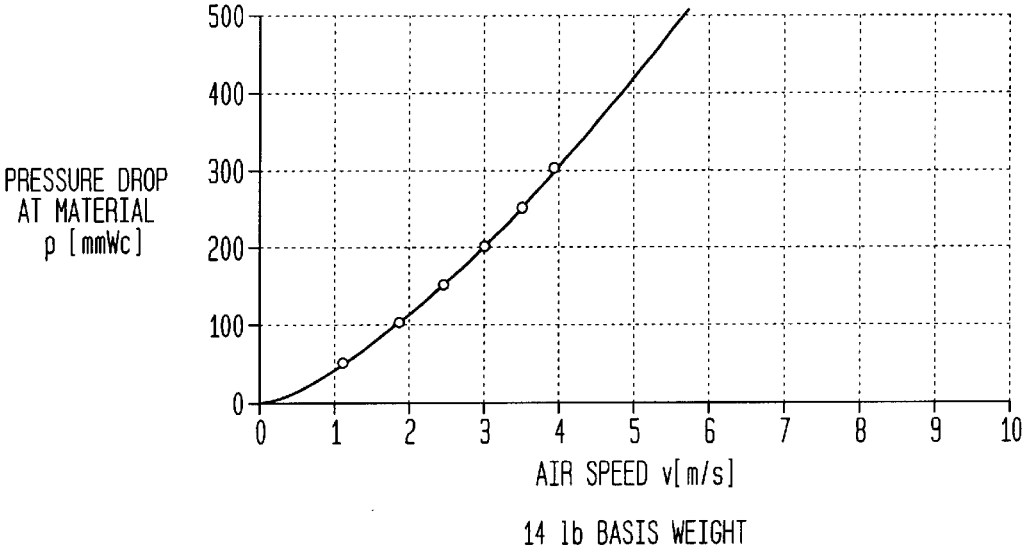

FIG. 3(*a*) is a plot of drying time versus moisture content for a dry creped, 14 lb/300 $ft^2$ product made with recycle furnish, wherein the drying temperature was 230° C. and the pressure drop was about 370 mm water through the sheet. FIG. 3(*b*) of air speed through the sheet utilized to generate the drying time data in FIG. 3(*a*) versus pressure drop at 0% moisture content.

Figure 4A:
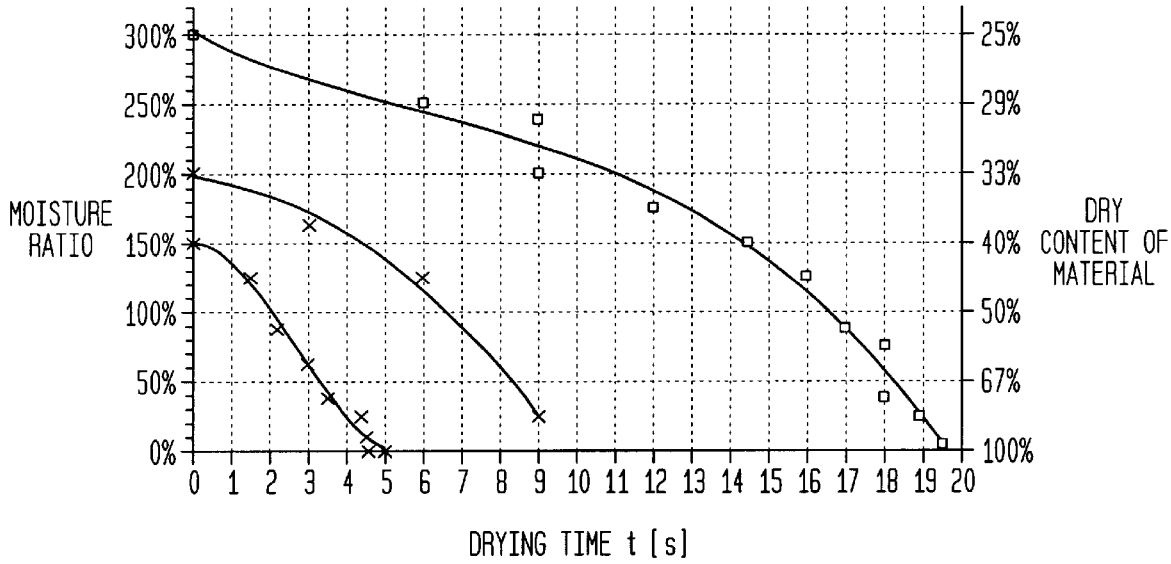
FIGS. 4(*a*) and 4(*b*) are plots showing drying time and air permeability for a 28 lb/3000 ft$^2$ basis weight absorbent sheet.
Figure 4B:
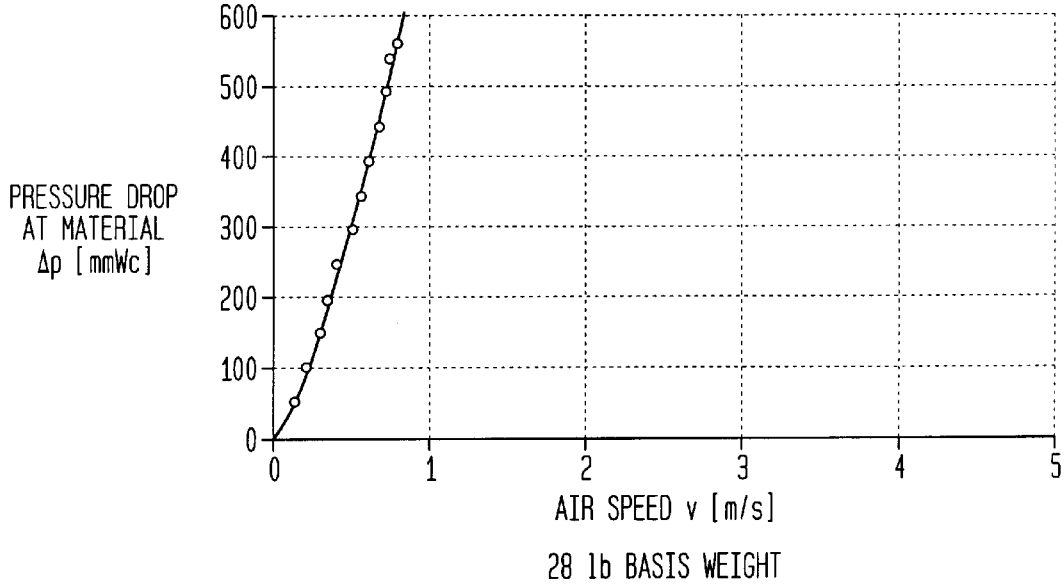

FIG. 4(*a*) is a plot of drying time versus moisture content starting at various moisture levels at time=0 for a 28 lb/3000 $ft^2$, wet creped product made with recycle furnish wherein the drying temperature was about 220° C. and the pressure drop was about 480 mm of mercury through the sheet. FIG. 4(*b*) is a lot of air speed through the sheet utilized to generate the data of FIG. 4(*a*) versus pressure drop through the sheet.

The data of FIGS. 1(*a*) through 4(*b*) may be utilized to compare a thoughdry process with an impingement air dry process of the present invention as shown in Table 1 below, wherein drying is calculated beginning at 25% consistency and continuing to 95% consistency.

TABLE 1

Comparison of Throughdry Processing With Impingement Air Drying

| Basis Weight (lbs/3000 $ft^2$) | Drying Time (From 25% Cons) | Air Flow Rate (500 mm Δp) | TAD Length (@ Commercial Speed) | Invention Drying Length* (@ 30/40 lbs/hr-$ft^2$) |
|---|---|---|---|---|
| 9 | 0.5 sec's | >10 m/sec | 50 ft (6000 fpm) | 106/80 ft (6000 fpm) |
| 13 | 5.0 sec's | 0.25–2 m/sec | 433 ft (5200 fpm) | 133/100 ft (5200 fpm) |
| 14 | >1.0 sec's | 6 m/sec | >83 ft (5000 fpm) | 138/103 (5000 fpm) |
| 28 | 19.5 sec's | 0.75 m/sec | 1170 ft (3000 fpm) | 165/124 (3000 fpm |

*Basis: Begin drying at 25% consistency (3 lbs water/lb fiber) and finish drying at 95% consistency.

Clearly, while through air dry lengths of 50–100 feet could be considered practical in connection with 16–18 foot diameter throughdryers with 270 degrees of wrap, lengths above this would not be. Thus, for sheet with low permeability, throughdrying is simply not practical. Further savings can be reached by cascading upline the relatively low humidity heated air used in downline or subsequent impingement air dryers when a plurality of dryers are used. This latter feature of the present invention is better appreciated in connection with FIGS. 5 and 6, further discussed below.

Figure 5:
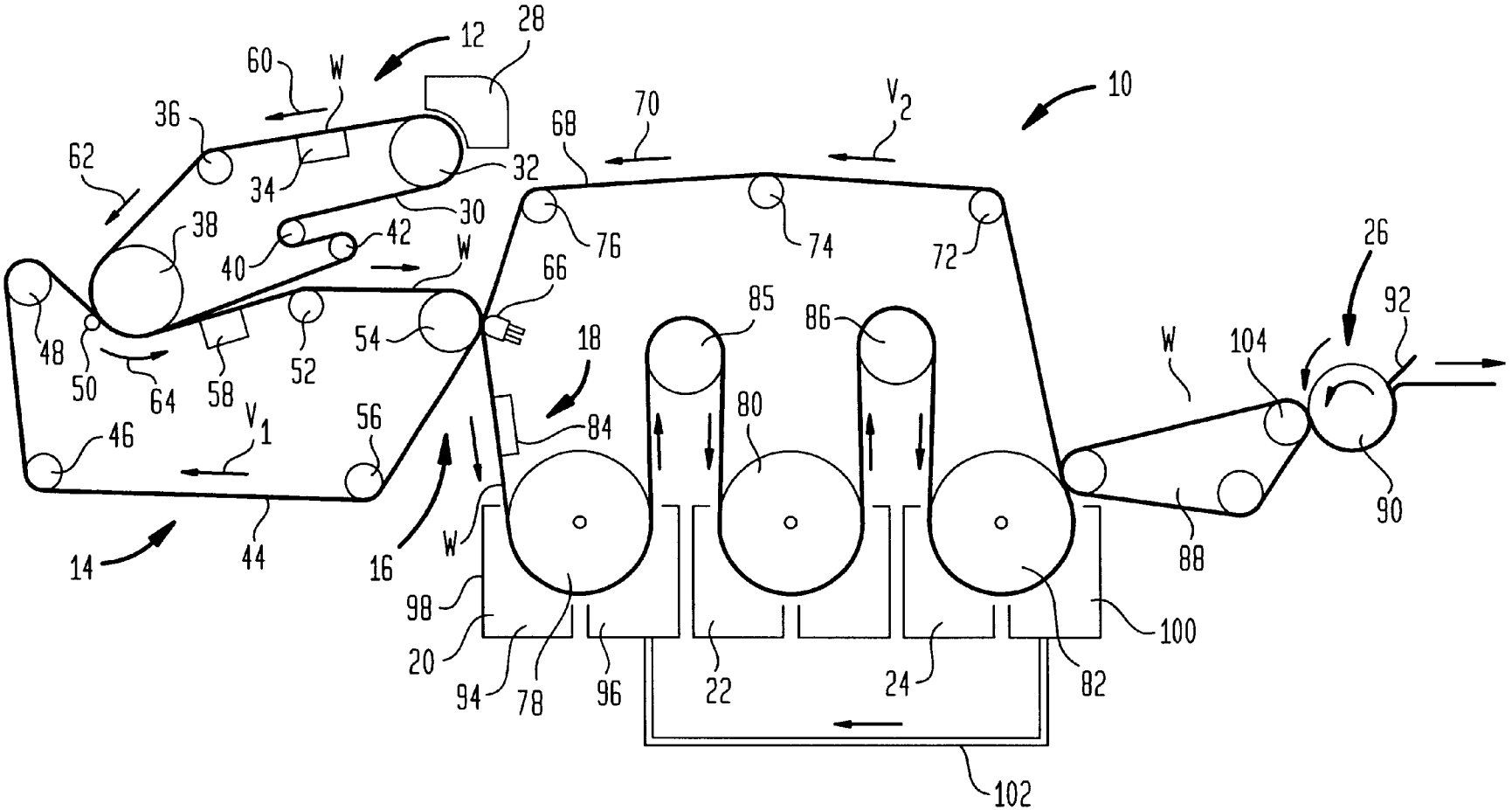
FIG. 5 is a schematic diagram of a papermaking machine useful for practicing the process of the present invention.

There is shown in FIG. 5 a papermaking apparatus 10 useful for practicing the present invention. Apparatus 10 includes a forming section 12, an intermediate carrier section 14, a transfer zone indicated at 16, a pre-dryer/imprinting section 18 and a plurality of impingement air dryers 20, 22, 24 which include rotating vacuum cylinders and impingement air hoods as described below. Also optionally provided is a crepe section 26.

In section 12 there is provided a headbox indicated at 28, as well as a forming fabric 30 looped about a breast suction roll 32. A vacuum box 34 non-compressively dewaters furnish deposited on fabric 30 by way of headbox 28. Fabric 30 is also looped over rolls 36, 38, 40 and 42.

Intermediate carrier section 14 includes an intermediate carrier fabric 44 which is supported on rolls 46–56. Fabric 44 also passes over another vacuum box 58 which further serves to dewater a nascent web W, traveling in the direction indicated by arrows 60–64. Fabric 44 also passes over an arcuate portion of roll 38, as well as transfer head 66. Biasing means may be provided to obviate slack in the various fabrics if so desired.

Transfer zone 16 includes fabric 44 as well as an impression of fabric 68, traveling in direction 70. Fabric 68 is looped around a plurality of support rolls 72–76 which may include biasing means as noted hereinabove, and is further lopped about cylinders 78, 80 and 82 respectively of impingement air dryers 20, 22 and 24 of apparatus 10. Further provided is a molding vacuum box 84 which pulls a vacuum of from about 10 to 30 inches of mercury and is operative to thus macroscopically rearrange web W to conform to the shape of impression fabric 68, that is, to shape the wet web and provide a structure to the product defined by fabric 68. The speeds of fabric 68 and 44 are independently controlled, with fabric 68 traveling slower than fabric 44, thereby carrying out a so-called "rush-transfer" during manufacture of a web of the present invention. The transfer from fabric 44 to 68 is thus carried out as described in U.S. Pat. No. 4,440,597 to Wells et al., the disclosure of which is incorporated by reference.

Apparatus 10 further includes a plurality of vacuum reversing cylinders 85, 86 arranged in a row parallel to the row defined by cylinders 78, 80 and 82 as well as another transfer fabric 88 and a heated rotating creping cylinder 90 provided with a creping blade 92 in creping section 26.

In operation, web W is formed on fabric 30, transferred to fabric 44 which travels at a velocity, VI. From fabric 44, web W is transferred to fabric 68 at transfer section 18 wherein transfer is aided by way of vacuum transfer head 66 as shown. Transfer fabric 68, which is a coarse impression fabric as noted above, travels at a velocity, V2, which is characteristically in accordance with the invention smaller than velocity VI of fabric 44.

After transfer, web W is macroscopically rearranged at imprinting section 18 by vacuum box 84 before it is further impingement air dried on impression fabric 68 by impingement air dryers 20, 22 and 24 which are arranged as shown. Typically, impingement air dryers utilized in accordance with the invention may be impingement air dryers with two drying zones, such as zones 94, 96 in a hood 98 of dryer 20. Vacuum cylinders, such as cylinders 78–82 may be 12 feet in diameter and reversing vacuum rolls 85, 86 may be 6 feet in diameter.

Optionally, a downstream dryer hood, such as the hood 100 of dryer 24 is coupled to an upstream hood such as hood 98 by way of a conduit 102. In this way, exhaust air from impingement dryer hood 100, operating at relatively low humidity, can be cascaded upline to hood 98 in order to conserve energy, that is, to reduce the energy needed by gas-fired dryers to pre-heat the drying air.

Generally, drying air temperatures may be from about 125° C. to about 175° C. in the hoods with about 150° C. being typical. In general, the consistency (solids content) of the web is from about 30–70 percent prior to being impingement air dried and is preferably dried to a consistency of at least about 90 percent solids, more preferably web W is dried to a solids content of at least about 95 percent by dryers 20–24.

After impingement air drying, web W may be calendared and wound or optionally transferred to fabric 88 which may be a coarse impression fabric as described above. The web is then knuckled onto a creping cylinder by way of roll 104 to selectively densify the web and creped to provide further machine direction stretch to the product as described in U.S. Pat. No. 3,301,746 to Sanford et al., and U.S. Pat. No. 4,529,480 to Trokhan et al., the disclosures of which are hereby incorporated by reference.

Typical impingement air drying lengths in accordance with the invention may be between about 100 and 150 feet with drying rates of from about 30–40 lbs/$^2$-hr. Drying lengths are calculated for each dryer shown as degrees of wrap about the dryer cylinder divided by 360° times $\pi$ times the cylinder diameter in feet whereas the impingement air drying area per dryer is the drying length per cylinder times the (axial) length of the drying cylinder of the dryer.

Figure 6:
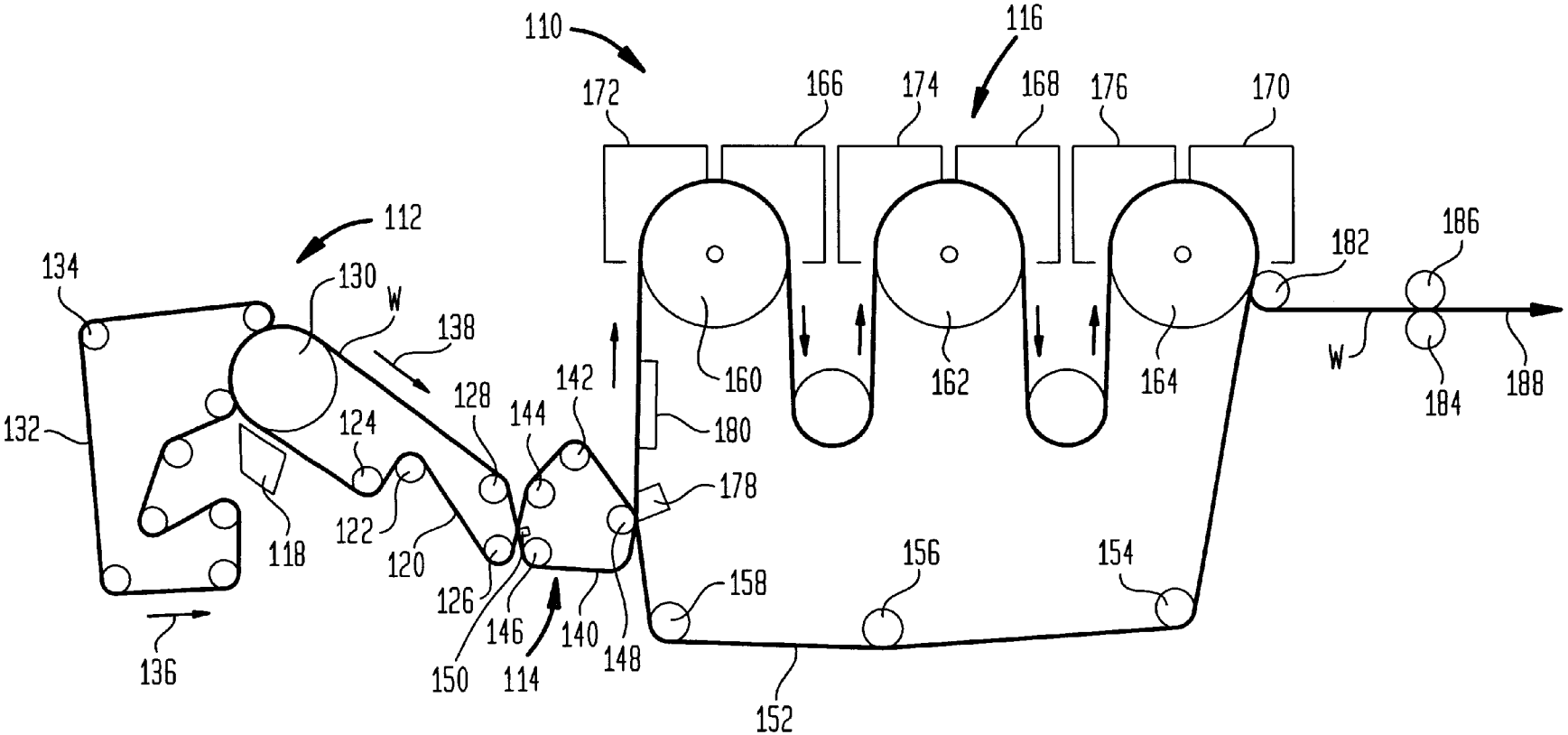
FIG. 6 is a schematic diagram of another papermaking machine useful for practicing the process of the present invention.

Another papermaking machine 110 suitable for producing uncreped, impingement air dried products in accordance with the present invention is shown in FIG. 6. Machine 110 includes generally a twin wire forming section 112, an intermediate transfer section 114 and an impingement air drying section 116 shown schematically in FIG. 6. Section 112 includes a headbox 118 which may be a layered or unlayered headbox which deposits a cellulosic papermaking furnish on a forming wire 120 which is supported by a plurality of rolls 122, 124, 126, 128 including a vacuum roll 130. Forming wire 132 is provided to assist in forming the nascent web W, and is supported by a plurality of cylindrical rolls such as roll 134. The respective forming wire 120, 132 travel in the direction 136, 138 as shown on FIG. 6 and web W may be dewatered by a vacuum box before being conveyed to transfer section 114 as shown in FIG. 6.

Transfer section 114 includes a transfer fabric 140 which may be an impression fabric provided with substantial texture orthogonal to the machine direction supported about a plurality of rolls 142–146 including roll 148. Also provided is a transfer head 150 which provides vacuum assist for the transfer of web W from wire 120 to fabric 140. Fabric 140 typically moves at a speed which is less than the speed of fabric 120 in order to provide microcontractions to web W as noted, for example, in U.S. Pat. No. 5,607,551, the disclosure of which is incorporated herein by reference, as well as has been noted in connection with FIG. 5 above.

Web W is transferred to another impression fabric 152 which is looped about a plurality of rolls 154–158 as well as about cylinders 160–164 of impingement air dryers 166–170 shown in FIG. 6. Impingement air dryers 166–170 are equipped with dual zone impingement air hoods 172–176 as described in connection with FIG. 5 and further described in connection with FIGS. 7(*a*) and 7(*b*) below.

Transfer of the web to fabric 152 is assisted by a vacuum head 178. Fabric 152 may be traveling at a velocity lower than fabric 140 to impart further machine direction stretch to web W. There is provided adjacent fabric 152 a vacuum box 180 for molding web W into fabric 152, generally by applying a vacuum of from about 10 to about 30 inches of mercury to web W which may have a consistency of about 50 percent which vacuum is operative to macroscopically rearrange the web and conform it to the shape of fabric 152.

After molding, the web is conveyed to dryers 166–170 and impingement air dried typically to a consistency of at least about 90 percent prior to being removed from fabric 152 at vacuum roll 182 and calendared by rolls 184, 186. Following calendaring, the web may be further processed in the direction 188 indicating, for example, the absorbent sheet might be embossed prior to being wound up.

Figure 7A:
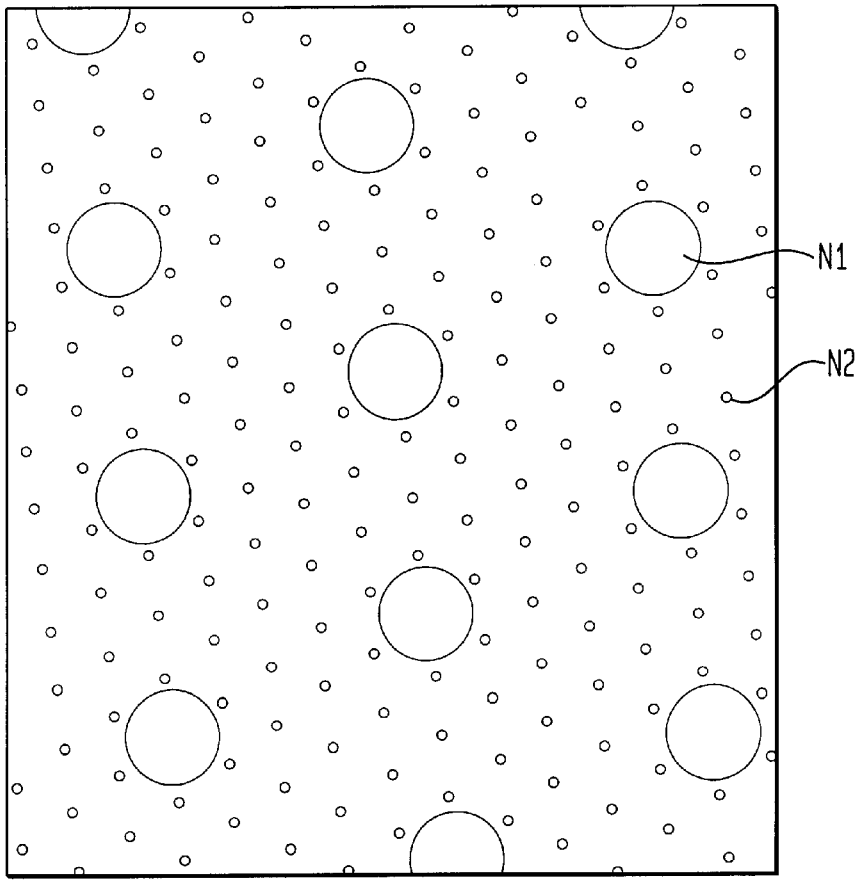
FIG. 7(*a*) is a schematic diagram illustrating details of an impingement air dryer useful in connection with the present invention.
Figure 7B:
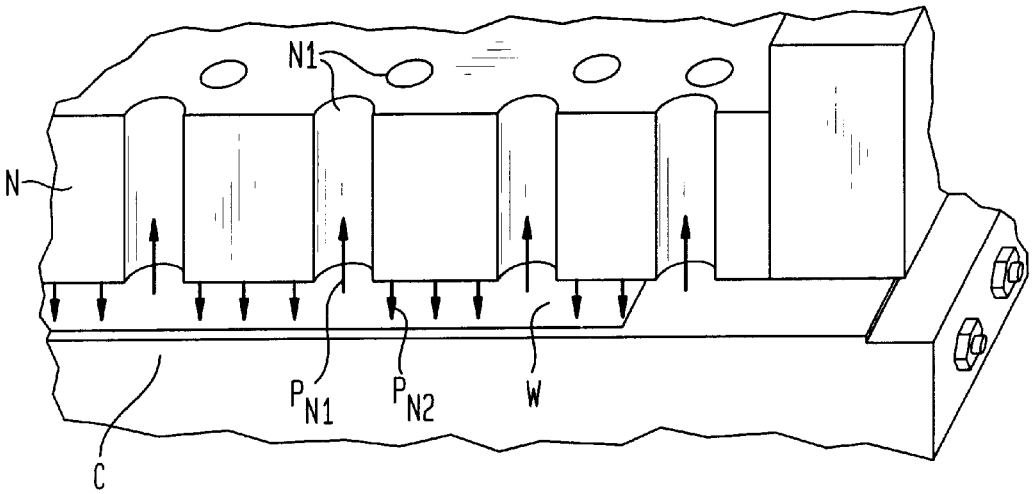

The air flow in the impingement air dryer hoods is illustrated in FIGS. 7(*a*) and 7(*b*). FIGS. 7(*a*) and 7(*b*) are schematic illustrations of the construction of the surface of the impingement drying device utilized in connection with the present invention and described herein. In the impingement blowing device, blow holes are denoted by reference N2 and direct air flow $P_{N2}$ toward the web and exhaust air pipes are denoted by reference N1 and remove an air flow $P_{N1}$ from the vicinity of the web. The diameter of each exhaust air pipe N1 is about 50 mm to about 100 mm, preferably about 75 mm and the diameter of each blow hole is about 3 mm to about 8 mm, most commonly about 5 mm. The paper web W runs at a distance of from about 10 mm to about 150 mm, preferably about 25 mm, from the face of the nozzle plate and the nozzle chamber of the hood is denoted by reference letter N. The vacuum cylinder against which the impingement air drying device is arranged is denoted by reference letter C in FIG. 7(*b*), it being understood that this is the arrangement of the various elements of FIGS. 5 and 6. The open area of the blow holes and the nozzle plate in the area of web W is from about 1 percent to about 5 percent and most commonly about 1.5 percent. The velocity of air in the blow holes is about 40 meters per second to about 150 meters per second, preferably about 100 mps. The heated air impinges upon fabric W which is on an impression fabric, further shaping the web. The air quantity that is blown is from about 0.5 to about 2.5 cubic meters per second per square meter which is calculated for the effective area of the drying unit. Most commonly an air quantity of from about 1 to about 1.5 cubic meter per second per square meter is used. The open area of the exhaust air pipes is from about 5 percent to about 15 percent, most commonly about 10 percent. In addition to the nozzle face illustrated in FIG. 7(*a*) it is possible to use a slot nozzle construction, fluid nozzle construction, foil nozzle construction or a direct blow nozzle construction as well as, for example, infra dryers. As can be seen, both the impinging air and the exhaust thereof is on the same side of web W.

While the invention has been described and illustrated in connection with numerous embodiments, modifications within the spirit and scope of the present invention, set forth in the appended claims, will be readily apparent to those of skill in the art.

What is claimed is:

1. A method of making an absorbent sheet comprising:

(a) depositing an aqueous furnish comprising cellulosic fiber on a forming fabric;

(b) dewatering the wet web to a consistency of from about 15 to about 40 percent;

(c) transferring the dewatered web at said consistency of from about 15 to about 40 percent to another fabric traveling at a speed of from about 10 to about 80 percent slower than the speed of the dewatered web prior to such transfer in order to impart machine direction stretch into the absorbent sheet;

(d) macroscopically rearranging said web to conform to the surface of an impression fabric; and (e) impingement air drying said web to form said absorbent sheet.

2. The method according to claim 1, wherein the wet web is dewatered to have a consistency of from about 20 to about 30 percent upon transfer in step (c).

3. The method according to claim 1, wherein said web is impingement air dried at a water removal rate of from about 25 lbs/hr-ft$^2$ to about 50 lbs/hr-ft$^2$.

4. The method according to claim 3, wherein said web is impingement air dried at a water removal rate of from about 30 lbs/hr-ft$^2$ to about 40 lbs/hr-ft$^2$.

5. The method according to claim 1, wherein said web is impingement air dried over an impingement air drying length of from about 50 to about 300 ft.

6. The method according to claim 5, wherein said web is impingement air dried over an impingement air drying length of from about 75 to about 200 ft.

7. The method according to claim 6, wherein said web is impingement air dried over an impingement air drying length of from about 100 ft. to about 150 ft.

8. The method according to claim 1, wherein said step of impingement air drying said web comprising drying said web with a plurality of sequentially arranged impingement air dryers.

9. The method according to claim 8, wherein impingement exhaust air from a downline dryer is cascaded backward to an upline impingement air drier.

10. The method according to claim 1, wherein said absorbent sheet has a basis weight of at least about 10 lbs/3000 ft$^2$.

11. The method according to claim 10, wherein said absorbent sheet has a basis weight of at least about 15 lbs/3000 ft.

12. The method according to claim 11, wherein said absorbent sheet has a basis weight of at least about 20 lbs/3000 ft$^2$.

13. The method according to claim 1, wherein the cellulosic fiber present in said furnish comprises recycle fiber.

14. The method according to claim 13, wherein the recycled fiber in said aqueous furnish comprises at least about 50 percent by weight of the fiber present.

15. The method according to claim 14, wherein the recycled fiber in said aqueous furnish comprises at least about 75 percent by weight of the fiber present.

16. The method according to claim 1, wherein said step of impingement air drying said web comprises impingement air drying said web on an impression fabric supported on a vacuum cylinder in opposed facing relationship with an impingement air drying hood.

17. The method according to claim 1, further comprising the steps of: (f) adhering the impingement air dried web to a rotating cylinder and (g) creping said web from said cylinder.

18. The method according to claim 17, wherein said rotating cylinder is a heated rotating cylinder.

19. The method according to claim 17, wherein the impingement air dried web is applied to said rotating cylinder with the aid of an adhesive.

20. The method according to claim 1, wherein said web is impingement air dried on said impression fabric to a consistency of at least about 90%.

21. The method according to claim 20, wherein said web is impingement air dried to a consistency of at least about 95%.

22. An absorbent sheet made by the method according to claim 1.

23. The method according to claim 1, wherein said aqueous furnish comprises recycled fiber.

24. The method according to claim 23, wherein the recycled fiber in said aqueous furnish comprises at least about 50 percent by weight of the fiber present.

25. The method according to claim 24, wherein the recycled fiber present in said aqueous furnish comprises at least about 75 percent by weight of the fiber present.

26. The method according to claim 1, wherein at least about 10 percent of the fiber in said aqueous furnish has been subjected to a curling process.

27. The method according to claim 26, wherein at least about 25 percent of the fiber present in said aqueous furnish has been subjected to a curling process.

28. The method according to claim 27, wherein at least about 50 percent of the fiber in said aqueous furnish has been subjected to a curling process.

29. The method according to claim 28, wherein at least about 75 percent of the fiber in said aqueous furnish has been subjected to a curling process.

30. The method according to claim 29, wherein at least about 90 percent of the fiber in said aqueous furnish has been subjected to a curling process.

31. The method according to claim 26, wherein said method of curling said fiber comprises concurrently heat treating and convolving said fiber at an elevated temperature.

32. The method according to claim 31, wherein said fiber is curled in a disk refiner with saturated steam at a pressure of from about 5 to about 150 psig.

33. The method according to claim 1, wherein said step of depositing said aqueous cellulosic furnish on said forming fabric includes foam forming said furnish on said forming fabric.

34. The method according to claim 1, wherein said aqueous furnish comprises a cationic debonding agent.

35. The method according to claim 34, wherein said aqueous furnish further comprises a non-ionic surfactant.

36. The method according to claim 1, wherein said web is impingement air dried at an impingement air drying rate of at least about 30 pounds of water removed per square foot of impingement air drying surface per hour.

37. The method according to claim 36, wherein said web is impingement air dried at an impingement air drying rate of at least about 40 pounds of water removed per square foot of impingement air drying area surface per hour.

38. A method of making an absorbent sheet comprising:

(a) depositing an aqueous furnish comprising cellulosic fiber on a forming fabric;

(b) dewatering the wet web to a consistency of from about 15 to about 40 percent;

(c) transferring the dewatered web from the forming fabric to a transfer fabric traveling at a speed of from about 10 to about 80 percent slower than the forming fabric;

(d) transferring the web to an impression fabric whereupon the web is macroscopically rearranged to conform to the surface of the impression fabric; and (e) impingement air drying the web.

39. The method according to claim 38, wherein the wet web is dewatered to a consistency of from about 20 to about 30 percent in Step (b).

40. The method according to claim 38, wherein the transfer fabric is traveling at a speed of from about 15 to about 40 percent slower than the forming fabric.

* * * * *